US006776708B1

(12) United States Patent
Daoutis et al.

(10) Patent No.: US 6,776,708 B1
(45) Date of Patent: Aug. 17, 2004

(54) SMOKE EXTRACTION SYSTEM

(76) Inventors: Rick Daoutis, 3020 Tanforan, Bakersfield, CA (US) 93308; Bill Nicks, 918 El Tenon, Bakersfield, CA (US) 93308

( * ) Notice: Subject to any disclaimer, the term of this patent is extended or adjusted under 35 U.S.C. 154(b) by 0 days.

(21) Appl. No.: 10/351,865

(22) Filed: Jan. 27, 2003

(51) Int. Cl.[7] ..... F24F 11/00
(52) U.S. Cl. ..... 454/229; 454/342
(58) Field of Search ..... 454/228, 229, 454/236, 342

(56) References Cited

U.S. PATENT DOCUMENTS

| | | | | |
|---|---|---|---|---|
| 2,586,797 | A | | 2/1952 | Dunlop, et al. |
| 3,741,101 | A | | 6/1973 | Sheppard |
| 3,826,180 | A | | 7/1974 | Hayashi |
| 3,884,133 | A | | 5/1975 | Miller |
| 3,923,096 | A | | 12/1975 | van der Lely |
| 3,926,101 | A | | 12/1975 | Moss |
| 4,058,253 | A | * | 11/1977 | Munk et al. ..... 236/46 R |
| 4,063,595 | A | | 12/1977 | Phillips |
| 4,084,744 | A | | 4/1978 | Wilson, Jr. |
| 4,765,231 | A | | 8/1988 | Aniello |
| 4,818,970 | A | | 4/1989 | Natale et al. |
| 4,944,216 | A | * | 7/1990 | McCutchen ..... 454/342 |
| 5,260,691 | A | | 11/1993 | Shyn |
| 6,053,809 | A | | 4/2000 | Arceneaux |
| 6,118,381 | A | | 9/2000 | James |
| 6,161,764 | A | * | 12/2000 | Jatnieks ..... 236/49.3 |
| 6,474,086 | B1 | * | 11/2002 | Liu ..... 62/183 |
| 6,609,967 | B2 | * | 8/2003 | Sharp et al. ..... 454/236 |

* cited by examiner

*Primary Examiner*—Harold Joyce
(74) *Attorney, Agent, or Firm*—Michael I. Kroll

(57) ABSTRACT

The invention discloses a smoke extraction system 10 provided with an infrared smoke detector 16, infrared thermostat 18, A/C sensor 38 and transition door 20. When the smoke detector 16 detects smoke 32 it sends a signal to the thermostat 18 changing the setting to exhaust mode, at the same time the signal is received by the A/C sensor 38 electronics of the transition door 20, which opens the transition door allowing smoke to be vented to the outside. When the air conditioning unit engages the vent mode, the air is vented through the transition door 20 thereby creating a draft that will remove the smoke 32 and vent it outside. The extraction system can be adapted to a central air conditioning system 12.

4 Claims, 11 Drawing Sheets

SMOKE EXTRACTION SYSTEM

BACKGROUND OF THE INVENTION

1. Field of the Invention

The present invention relates generally to smoke extraction and, more specifically, to a smoke extraction system designed to be adapted to new air conditioning units or can be provided as a retrofit unit in itself. The smoke extraction system is provided with an infrared smoke detector, infrared thermostat, A/C sensor and transition door. When the smoke detector detects smoke it sends a signal to the thermostat changing the setting to exhaust mode, at the same time the signal is received by the electronics of the transition door, which opens the transition door, thereby sealing the unit's supply side air, allowing smoke to be vented to the outside. The extraction system can be adapted to a central air conditioning system. One or more smoke detectors having signal transmission capabilities signal the thermostat to engage the venting mode of the air conditioning unit. The thermostat also triggers a signal to the electronics controlling an exhaust portal located within the air condition unit. When the air conditioning unit engages the vent mode, the air is venting through the transition door thereby creating a draft that will remove the smoke and vent it outside.

2. Description of the Prior Art

There are other smoke extraction devices designed for extracting smoke. Typical of these is U.S. Pat. No. 2,586,797 issued to Dunlop et al on Feb. 26, 1952.

Another patent was issued to Sheppard on Jun. 26, 1973 as U.S. Pat. No. 3,741,101. Yet another U.S. Pat. No. 3,826,180 was issued to Hayashi on Jul. 30, 1974 and still yet another was issued on May 20, 1975 to Miller as U.S. Pat. No. 3,884,133.

Another patent was issued to van der Lely on Dec. 2, 1975 as U.S. Pat No. 3,923,096. Yet another U.S. Pat. No. 3,926,101 was issued to Moss on Dec. 16, 1975. Another was issued to Phillips on Dec. 20, 1977 as U.S. Pat. No. 4,063,595 and still yet another was issued on Aug. 23, 1988 to Aniello as U.S. Pat. No. 4,765,231.

Another patent was issued to Natale et al. on Apr. 4, 1989 as U.S. Pat. No. 4,818,970. Yet another U.S. Pat. No. 5,260,691 was issued to Shyu on Nov. 9, 1993. Another was issued to Arceneaux on Apr. 25, 2000 as U.S. Pat. No. 6,053,809 and still yet another was issued on Sep. 12, 2000 to James as U.S. Pat. No. 6,118,381.

U.S. Pat. No. 2,586,797

Inventor: James Dunlop et al.

Issued: Feb. 26, 1952

The invention relates to protection against fumes resulting from fires in buildings and being vented to the outdoors. A system for protecting one portion of a building against fumes from a fire in another portion having an opening connecting it to the first named portion, said system comprising; a collection duct in said other portion adjacent said opening; an exhaust fan having its inlet connected to said duct and its outlet discharging outdoors; operating means for said fan; an air intake on said one portion side of said opening; and means for causing operation of said fan operating means when such fire occurs to draw air through said opening from said air intake into said other portion to create a draft through said opening to oppose the fumes and with said fumes entrained therewith into said duct and to discharge said air and fumes outdoors.

U.S. Pat. No. 3,741,101

Inventor: Albert S. Sheppard

Issued: Jun. 26, 1973

A gravity-operated automatically opening ventilator unit which is easily installed in the roof of a building and which, at a predetermined temperature, will automatically open to vent smoke, gases and heat from the interior of the building to atmosphere.

U.S. Pat. No. 3,826,180

Inventor: Toshikazu Hayashi

Issued: Jul. 30, 1974

This invention relates to a ventilator wherein an electronic circuit is actuated when a detecting element detects the existence of any smoke or gas while a fan is in a manual selected slow rotating node of operation or in a stand by halting position, and then the fan is automatically put into full rotation in order to expel smoke or such gas as carbon monoxide, and also for a specified period after completion of this expelling operation the fan is kept rotating during the above operation through the function of a delay-off circuit, with a shutter of a ventilating window being kept open by means of a switch network.

U.S. Pat. No. 3,884,133

Inventor: Edward J. Miller

Issued: May 20, 1975

A method of controlling smoke, ventilation and fire flash point temperature in a multi-zone building served by a central ventilation system using a divided common return air duct having separate branch damper connections for each zone for directing all return air from a fire zone into the other section of the common return air duct.

U.S. Pat. No. 3,923,096

Inventor: Cornelis van der Lely

Issued: Dec. 2, 1975

A multistory building which is comprised of a plurality of superimposed elongated box-shaped prefabricated sections, each of which encloses a portion of the living space in the building, each said section comprising a floor, at least one wall and a ceiling member, said wall extending higher than the top of said ceiling member, said wall extending higher than the top of said ceiling member whereby an air space constituting a channel for transporting air is defined in each said section by the top of said ceiling member, air conditioning means provided in the building in passage communication with said air space of each said section whereby air conditioned by said air conditioning means is received in said air space, said wall being adjacent said air space and the bottom of the floor of the section next above being adjacent to and defining the top of said air space, each said ceiling member and said floor comprising heat exchange means between said air space and the living space in the sections adjacent each whereby with a difference in temperature between the air in said air space and the air in said living space a heat transfer occurs through said member and said floor relative to said living space each said section having an opening in said ceiling member for the passage of air between said air space and the living space defined by such section, closure means in said opening and adjustment means for selectively opening said closure means, and thermostatic means in the living space provided by such section adapted to control said adjustment means.

U.S. Pat. No. Des. 3,926,101

Inventor: Cyril H. Moss

Issued: Dec. 16, 1975

This invention relates to systems for cleaning smoke from buildings when a fire occurs therein. A fire safety system for use in a building having a plurality of accommodation units and a plurality of communal units providing means of access to said accommodation units, said system including a plurality of smoke detectors in said communal units and means controlled by said smoke detectors and responsive to detection of smoke in one of said communal units to admit air under pressure to that communal unit and to restrict passage of smoke from that communal unit to another communal unit or other communal units.

U.S. Pat. No. 4,063,595

Inventor: Leonard Phillips

Issued: Dec. 20, 1977

An air conditioning system capable of regulating the temperature of incoming air and further comprising safety features relating to the sensing of abnormal conditions within a room or like treated area concerning the detection of fire, smoke or abnormally high temperature conditions. The flow of air from the exterior of the system is directed to the interior of the room or area being conditioned by a fan or like blower element while being conditioned through direct exposure to hot or cold conditioning fluid. Safety features include sensing elements connected to a liquid spray assembly as well as the blower and air intake so as to determine the amount of incoming air pressure as well as regulate the delivery of certain safety liquids such as water, through the spray assembly.

U.S. Pat. No. 4,765,231

Inventor: Michael J. Aniello

Issued: Aug. 23, 1988

Harmful smoke is drawn from rooms in an air conditioned building by way of duct work which supplies conditioned air to the rooms during normal operation. When a potentially harmful level of smoke is detected, supply fan motors associated with the duct work are reversed in direction so as to evacuate the smoke through registers in the rooms and into the duct work. The smoke is then exhausted away from the building occupants through an outside ventilating unit. Accordingly, the building occupants will have sufficient time to evacuate the building safely without succumbing to smoke inhalation.

U.S. Pat. No. 4,818,970

Inventor: Anthony Natale, et al.

Issued: Apr. 4, 1989

A fire condition detection and control system for use with air moving and filtering units. The system includes one or more remote fire condition detection units, which sense heat or smoke and, upon such sensing, transmit a signal indicative of an alarm condition to one or more air moving and filtering units located within a containment area. The transmission is by wireless radio frequency transmission and/or a wired transmission line or cable. The air moving and filtering units detect the alarm condition and disconnect power to the blower motor of the air moving and filtering unit. The receiver and control circuitry may be integral with the air moving and filtering unit, or may be part of a separate control unit that plugs into conventional air moving and filtering units.

U.S. Pat. No. 5,260,691

Inventor: Jia-Ming Shyu

Issued: Nov. 9, 1993

A combination fire alarm/air conditioner, which can immediately detect a fire. The device includes a temperature-sensor and/or a smoke-sensor installed in the room-side air inlet of the air conditioner. Signals generated by the sensor are received by a microcomputer which monitors them based on a threshold and a rate of change of the signals. When the rate of change of the signals exceeds the threshold, the microcomputer produces signals which set off an alarm.

U.S. Pat. No. 6,053,809

Inventor: Henry M. Arceneaux

Issued: Apr. 25, 2000

A system for detecting the presence of smoke within a building and providing means to remove the smoke, into the airspace above the ceiling thereby preventing or at least alleviating smoke inhalation, property damage, and allowing more time for the safe evacuation from the premises. The system is comprised of a conventional smoke detector which activates control means for raising and lowering a generally planar panel which is installed in a ceiling. Smoke is removed from the airspace below the ceiling to the airspace above the ceiling. An optional fan, remote fan relay, exhaust vent and back draft damper further aid in the exhausting of the smoke from the building. A fusible link in the control means protects the ceiling fire rating.

U.S. Pat. No. 6,118,381

Inventor: Robert Wilton James

Issued: Sep. 12, 2000

A system for the detection of fire in an apparatus or device having a fan and a pump, comprising means 20, 25 for detecting the presence of a pre-condition of fire, control means 30 for deactivating the fan on detection of said precondition, and fire detector means 35 for detecting smoke or fire in the absence of air movement.

While these smoke extraction systems may be suitable for the purposes for which they were designed, they would not be as suitable for the purposes of the present invention, as hereinafter described. The smoke extraction system of the present invention is provided with an infrared smoke detector, infrared thermostat, a/c sensor and transition door. When the smoke detector detects smoke it sends a signal to the thermostat changing the setting to exhaust mode, at the same time the signal is received by the electronics of the transition door, which opens the transition door allowing smoke to be vented to the outside. The extraction system can be adapted to a central air conditioning system. One or more smoke detectors having signal transmission capabilities signal the thermostat to engage the venting mode of the air conditioning unit. The thermostat also triggers a signal to the electronics controlling an exhaust portal located within the air condition unit. When the air conditioning unit engages the vent mode, the air is venting through the transition door thereby creating a draft that will remove the smoke and vent it outside.

SUMMARY OF THE PRESENT INVENTION

The present invention discloses a smoke extraction system provided with an infrared smoke detector, infrared thermostat, A/C sensor and transition door. When the smoke detector detects smoke it sends a signal to the thermostat changing the setting to exhaust mode, at the same time the signal is received by the electronics of the transition door, which opens sealing the supply side duct and creating an aperture in the A/C unit housing allowing smoke to be vented to the outside. The extraction system can be adapted to a central air conditioning system. One or more smoke detectors having signal transmission capabilities signal the thermostat to engage the venting mode of the air conditioning unit. The thermostat also triggers a signal to the electronics controlling an exhaust portal located within the air conditioning unit housing. When the air conditioning unit engages the vent mode, the air is venting through the transition door thereby creating a draft that will remove the smoke and vent it outside.

A primary object of the present invention is to provide a heat extraction system.

Another object of the present invention is to provide a heat extraction system designed to be adapted to an existing air conditioning unit or provided as a retrofit unit.

Yet another object of the present invention is to provide a heat extraction system providing an infrared smoke detector.

Still yet another object of the present invention is to provide a smoke extraction system that provides an infrared thermostat.

Another object of the present invention is to provide a smoke extraction system providing an a/c sensor and transition door.

Yet another object of the present invention is to provide a smoke extraction system that when smoke is detected the smoke detector sends a signal to the thermostat changing the setting to exhaust mode, at the same time the signal is received by the electronics of the transition door allowing smoke to be vented to the outside.

Still yet another object of the present invention is to provide a smoke extraction system that vents smoke using the duct work of a central air conditioning system. One or more smoke detectors have signal transmission capabilities signaling the thermostat to engage the venting mode of the air conditioning unit. The thermostat also triggers a signal to the electronics controlling an exhaust portal located within the air conditioning unit. When the air conditioning unit engages the vent mode, the air is vented through the transition door thereby creating a draft that will remove the smoke and vent it outside.

Additional objects of the present invention will appear as the description proceeds.

The present invention overcomes the shortcomings of the prior art by providing a heat extraction system designed to be adapted to an existing air conditioning unit or provided as a retrofit unit. Also, a smoke extraction system that when smoke is detected the smoke detector sends a signal to the thermostat changing the setting to exhaust mode, at the same time the signal is received by the electronics of the transition door allowing smoke to be vented to the outside. A smoke extraction system that vents smoke using the duct work of a central air conditioning system. One or more smoke detectors have signal transmission capabilities signaling the thermostat to engage the venting mode of the air conditioning unit. The thermostat also triggers a signal to the electronics controlling an exhaust portal located within the air conditioning unit. When the air conditioning unit engages the vent mode, the air is vented through the transition door thereby creating a draft that will remove the smoke and vent it outside.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
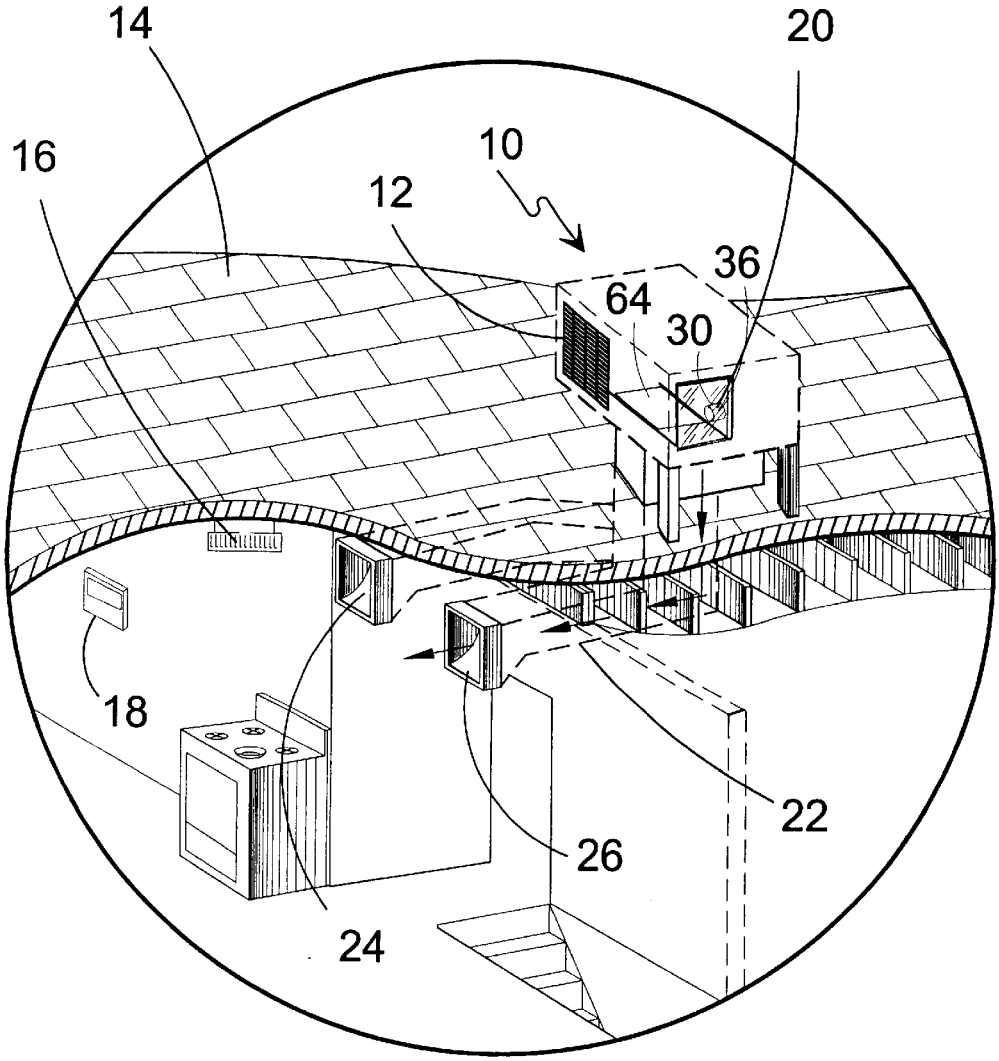
FIG. 1 is an illustrative view of the present invention in use. (Normal condition).

With regard to reference numerals used, the following numbering is used throughout the drawings.

10 smoke extraction system
12 existing air conditioning unit
14 roof
16 smoke detector
17 smoke detector reset button
18 thermostat

20 vent door
22 duct system
24 return duct
26 supply duct
30 door relay
32 smoke
33 fire
36 motor
37 direction arrow
38 A/C sensor
40 microprocessor
42 smoke detector #1
44 air duct #1
46 air duct #2
48 air duct #3
50 smoke detector #2
52 smoke detector #3
64 supply duct opening
66 return duct opening

DETAILED DESCRIPTION OF THE PREFERRED EMBODIMENT

The following discussion describes in detail one embodiment of the invention. This discussion should not be construed, however, as limiting the invention to those particular embodiments, since practitioners skilled in the art will recognize numerous other embodiments as well. For a definition of the complete scope of the invention, the reader is directed to the appended claims.

Turning to FIG. 1, shown therein is an illustrative view of the smoke extraction system 10 in use under non-smoke or normal conditions. The smoke extraction system of the present invention 10 is designed to be adapted to an existing air conditioning unit 12, e.g., on the roof 14 of an existing structure, or can be provided as a retrofit unit in itself. The smoke extraction system is provided with an infrared smoke detector 16, infrared thermostat 18, transition door relay 30, motor 36, A/C sensor and transition door 20. When the smoke detector 16 detects smoke it sends a signal to the thermostat 18 changing the setting to exhaust mode, at the same time the signal is received by the A/C sensor electronics and the transition door relay 30 of the transition door 20, which opens the transition or vent door 20 allowing smoke to be vented through the vent door 20, shown closed, to the outside. Also shown is the duct system 22 with return 24, supply 26 air ducts, and supply duct opening 64.

Figure 2:
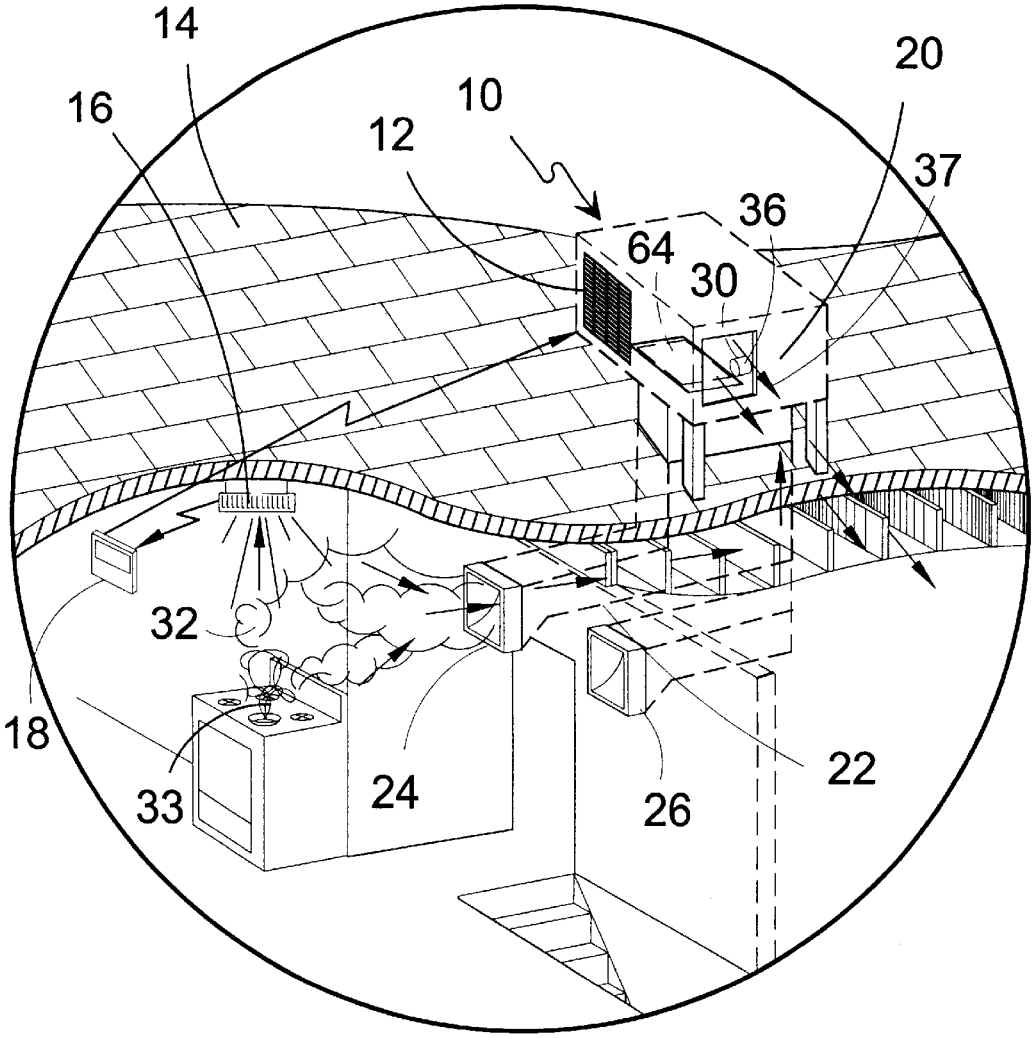
FIG. 2 is an illustrative view of the present invention in use. (Smoke condition).

Turning to FIG. 2, shown therein is an illustrative view of the present invention in use during a smoke condition. Shown is the smoke extraction system 10 venting smoke 32 using the duct system 22 of a central air conditioning unit 12 on roof 14. One or more smoke detectors 16 having signal transmission capabilities signal the thermostat 18 to engage the venting mode of the air conditioning unit 12. The thermostat 18 also triggers a signal to the electronics controlling an exhaust portal located within the air conditioning unit. When the air conditioning unit engages the vent mode, the air is vented through the transition door 20 shown by direction arrow 37 thereby creating a draft in the return air duct 24 that will remove the smoke and vent it outside through vent door 20. Also shown are the door relay 30, supply air duct 26, supply duct opening 64.

Figure 3:
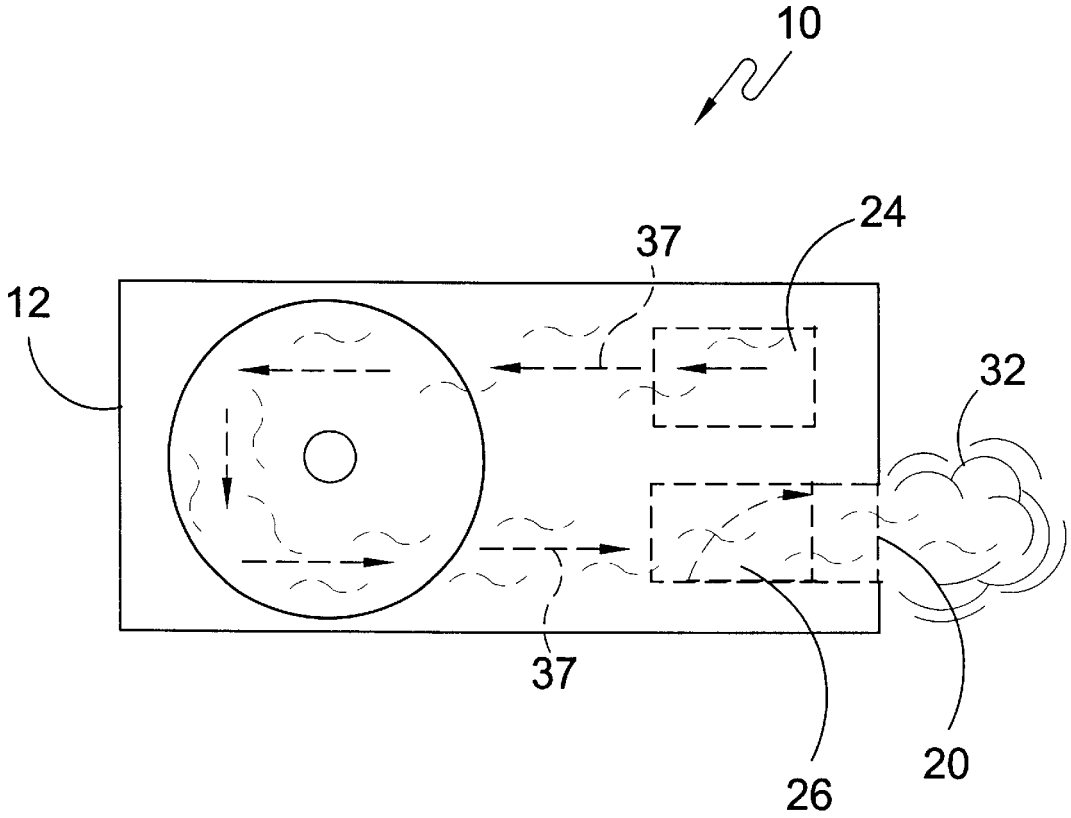
FIG. 3 is a top view of the a typical ac unit.

Turning to FIG. 3, shown therein is a top view of a typical ac unit. Shown is the smoke extraction system of the present invention having a motorized door 20 that under normal conditions remains closed for the A/C unit 12. If smoke 32 is detected the system engages the venting mode of the central air conditioning unit through the thermostat. Also shown is the return air duct 24 and air flow direction arrows 37.

Figure 4:
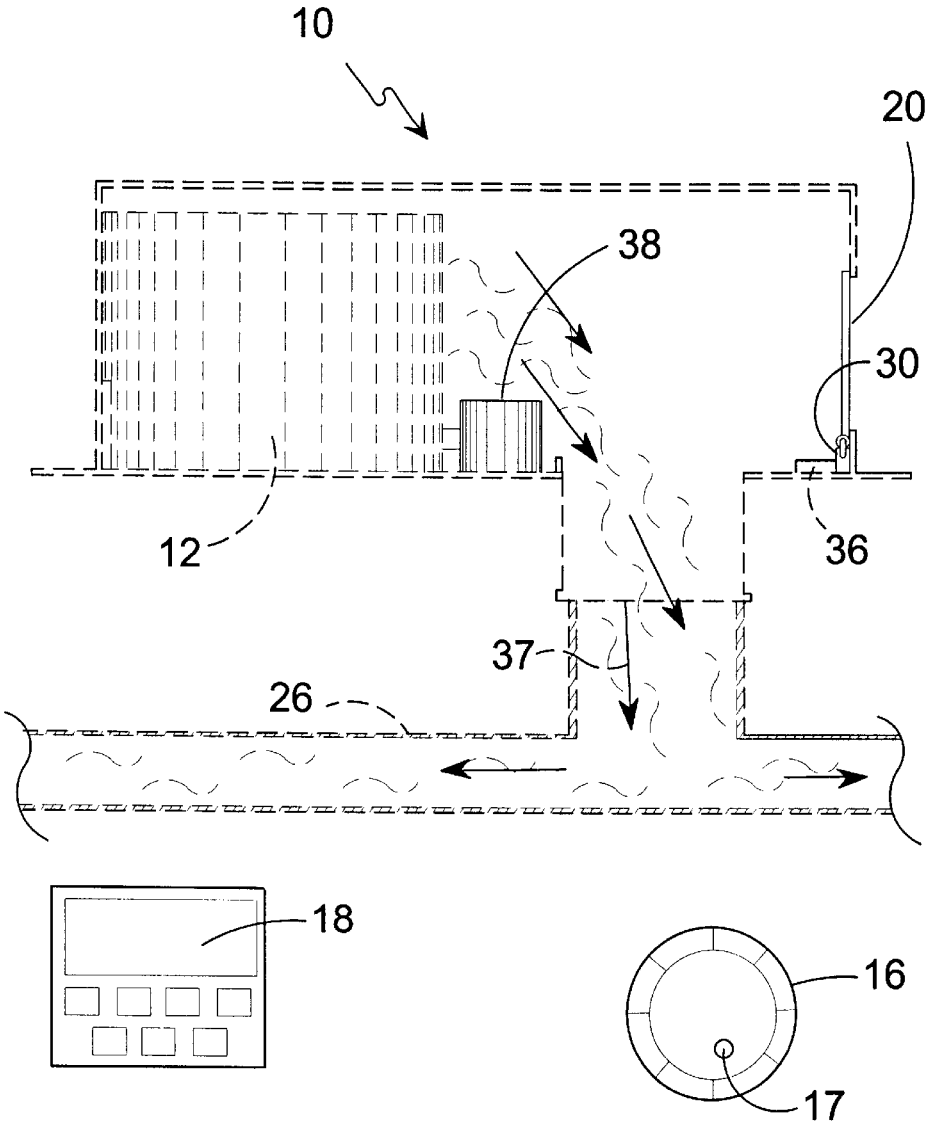
FIG. 4 is an illustrative view of the present invention in use. (Normal condition).

Turning to FIG. 4, shown therein is an illustrative view of the smoke extraction system 10 in use under normal conditions. Depicted are the normal operating conditions of a central air conditioning unit 12 having the smoke extraction system 10 installed therein. The smoke extraction system 10 has a motorized door 20 with a motor 36 and door relay 30 that under normal conditions remains closed. If smoke is detected the system engages the venting mode of the central air condition unit through the thermostat. Also shown are the A/C sensor 38, the supply air duct 26, air flow direction arrows 37, thermostat 18, and infrared smoke detector 16.

Figure 5:
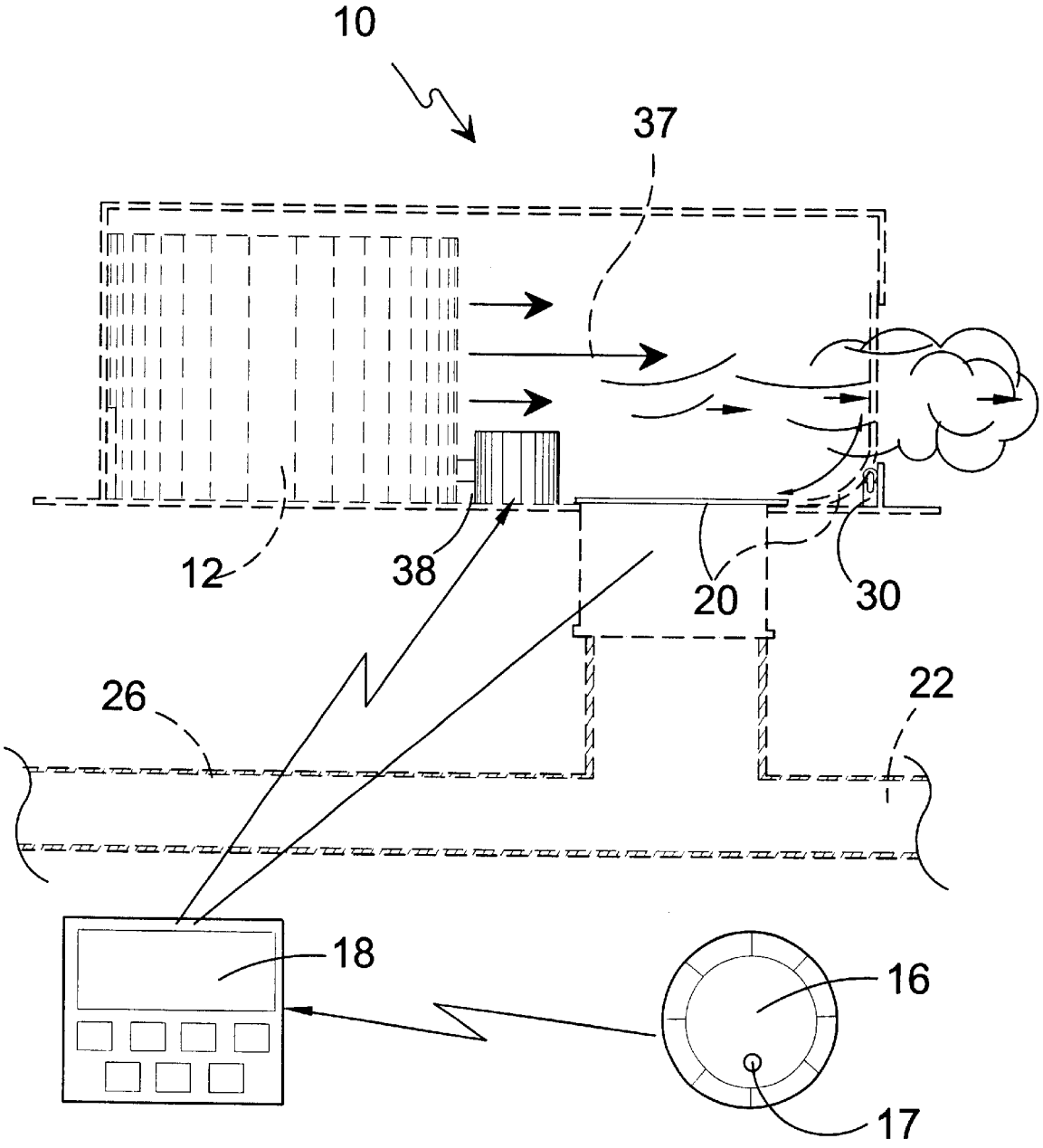
FIG. 5 is an illustrative view of the present invention in use. (Smoke condition).

Turning to FIG. 5, shown therein is an illustrative view of the smoke extraction system 10 in use during smoke conditions. Depicted is the smoke exhaust operating condition of a central air conditioning unit 12 having the smoke extraction system 10 installed therein. At least one smoke detector 16 signals the thermostat 18 to shut down the air conditioning mode if operational and to engage the a/c vent mode. Simultaneously the thermostat 18 signals the A/C sensor 38 which opens the transition door 20. The A/C vent air is exhausted over the a/c unit duct work shown by arrow 37 creating a draft that draws smoke out of the building and away from the A/C unit. Once a smoke condition has passed, the smoke detector contains a reset buttom 17 whereby the transition door 20 is closed. Also shown are the transition door relay 30, supply air duct 26, and air duct system 22.

Figure 6:
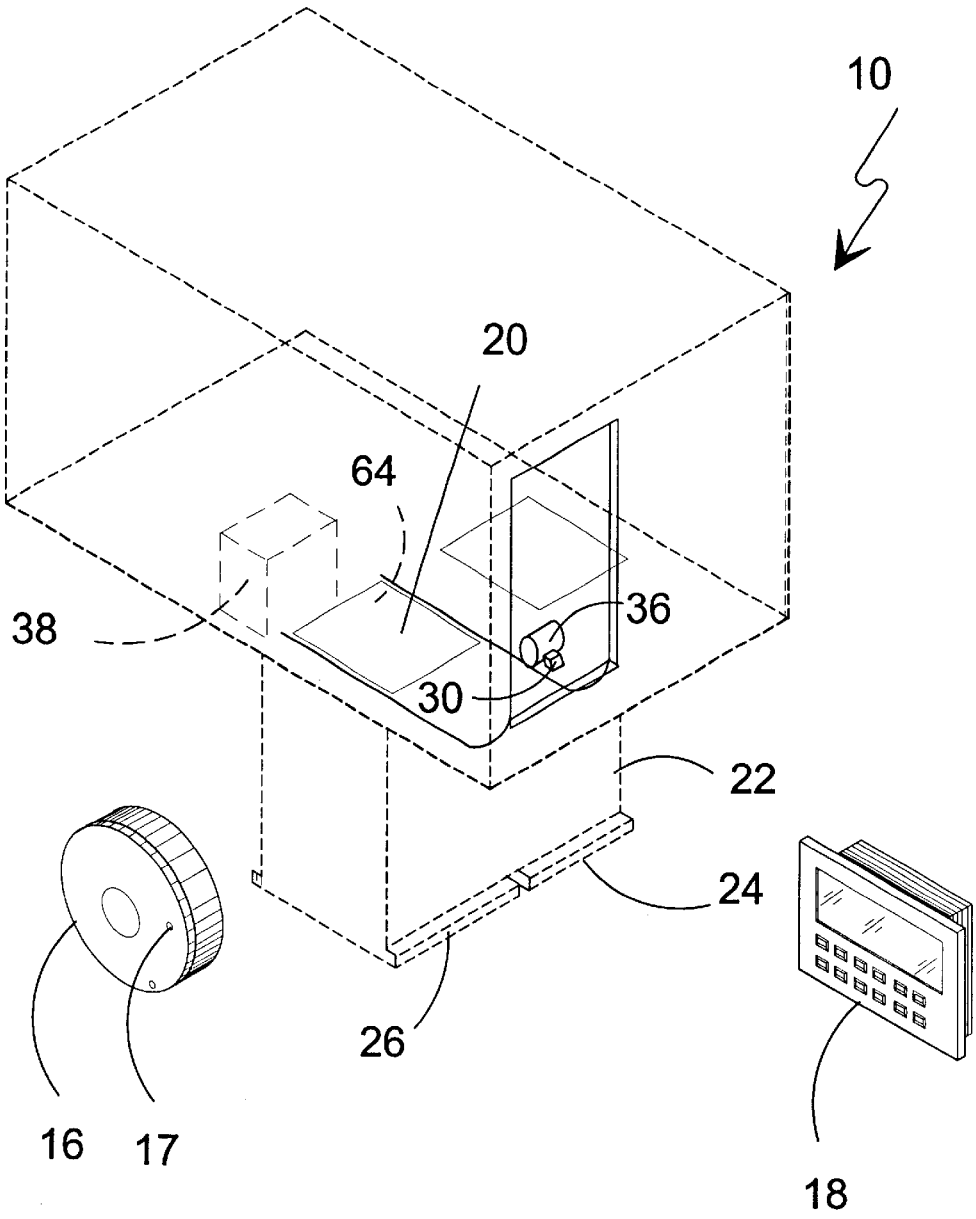
FIG. 6 is a perspective view of the present invention.

Turning to FIG. 6, shown therein is a perspective view of the smoke extraction system 10. The smoke extraction system 10 is designed to be manufactured with an existing air conditioning unit or can be provided as a retrofit unit as shown in the drawing. The smoke extraction system is provided with an infrared smoke detector 16, smoke extraction system reset 17, infrared thermostat 18, A/C sensor 38, door relay 30, motor 36 and transition door 20. When the smoke detector 16 detects smoke it sends a signal to the thermostat 18 changing the setting to exhaust mode, at the same time the signal is received by the electronics of the door relay 30 and motor 36 which opens the transition door 20 allowing smoke to be vented to the outside. Also shown are the air duct system 22, air return duct 24, air supply duct 26 and air supply duct opening 64.

Figure 7:
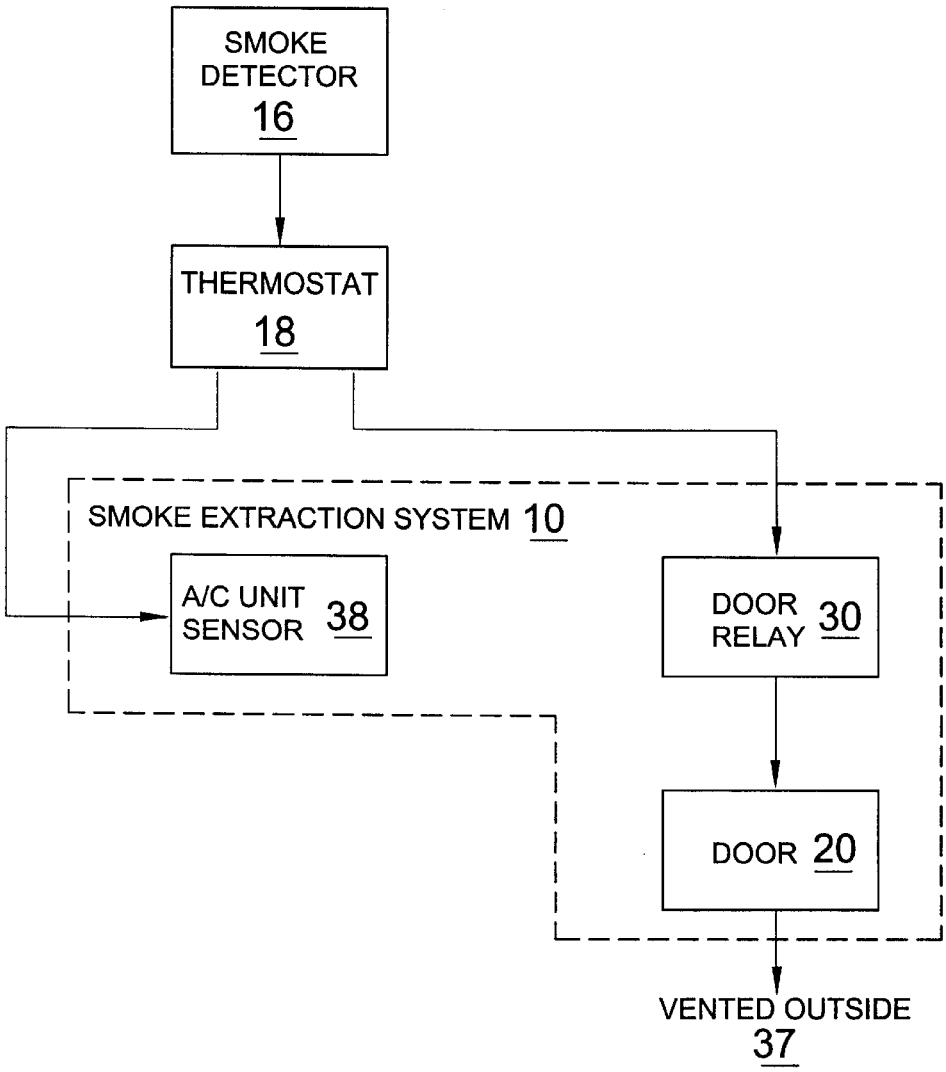
FIG. 7 is a block diagram of the present invention in use.

Turning to FIG. 7, shown therein is a block diagram of the present invention in use. The block diagram depicts the components of the smoke extraction system 10 and their functional relationship. The infrared smoke detector 16 signals the thermostat 18 to engage the venting system of the A/C unit in addition to signaling the transition door 20 of the smoke exhaust system housing to open. Whereupon, the venting A/C unit will exhaust out the transition door 20 causing a draft through the A/C duct work drawing the smoke to be exhausted away from the A/C unit out the transition door 20 as shown by arrow 37. Also shown are the A/C unit sensor 38 and door relay 30.

Figure 8:
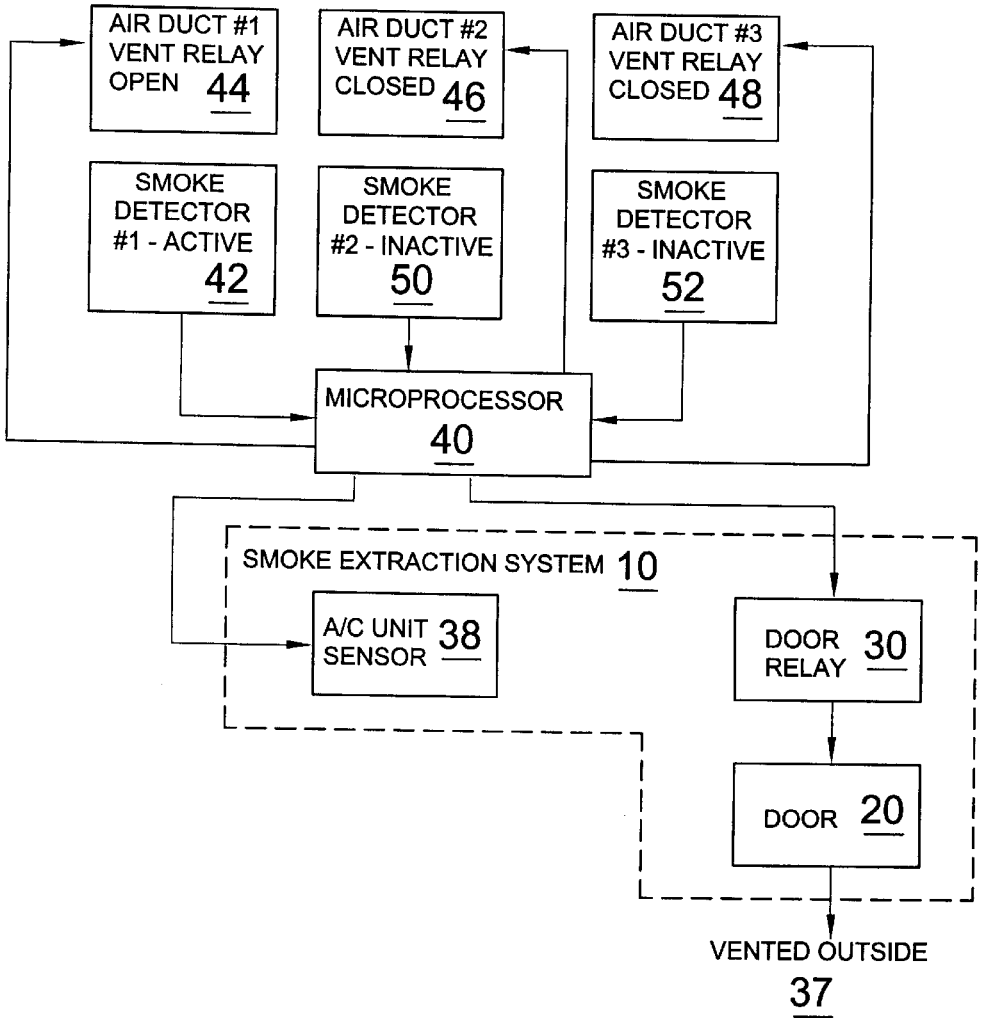
FIG. 8 is a block diagram of the present invention in use.

Turning to FIG. 8, shown therein is a block diagram of the present invention in use. The block diagram depicts the components of the smoke extraction system 10 of the present invention having a duct isolation feature wherein the microprocessor 40 automatically shuts any vents in the areas not detecting smoke while keeping the vents open in the areas where a smoke condition is detected thereby increasing the volume of air and smoke transferred there through. The figure shows smoke alarm #1, 42, detecting a smoke condition and leaving the respective vent 44 open while closing vent #2, 46, and vent #3, 48, where no smoke conditions currently exist at detector #2, 50, and #3, 52, thus concentrating the full power of the exhaust system to the area most needed. If a smoke condition becomes detected in one of the other areas then the respective vent will open as needed. Also shown are the A/C unit sensor 38, door relay 30, door 20 and air direction arrow 37.

Figure 9:
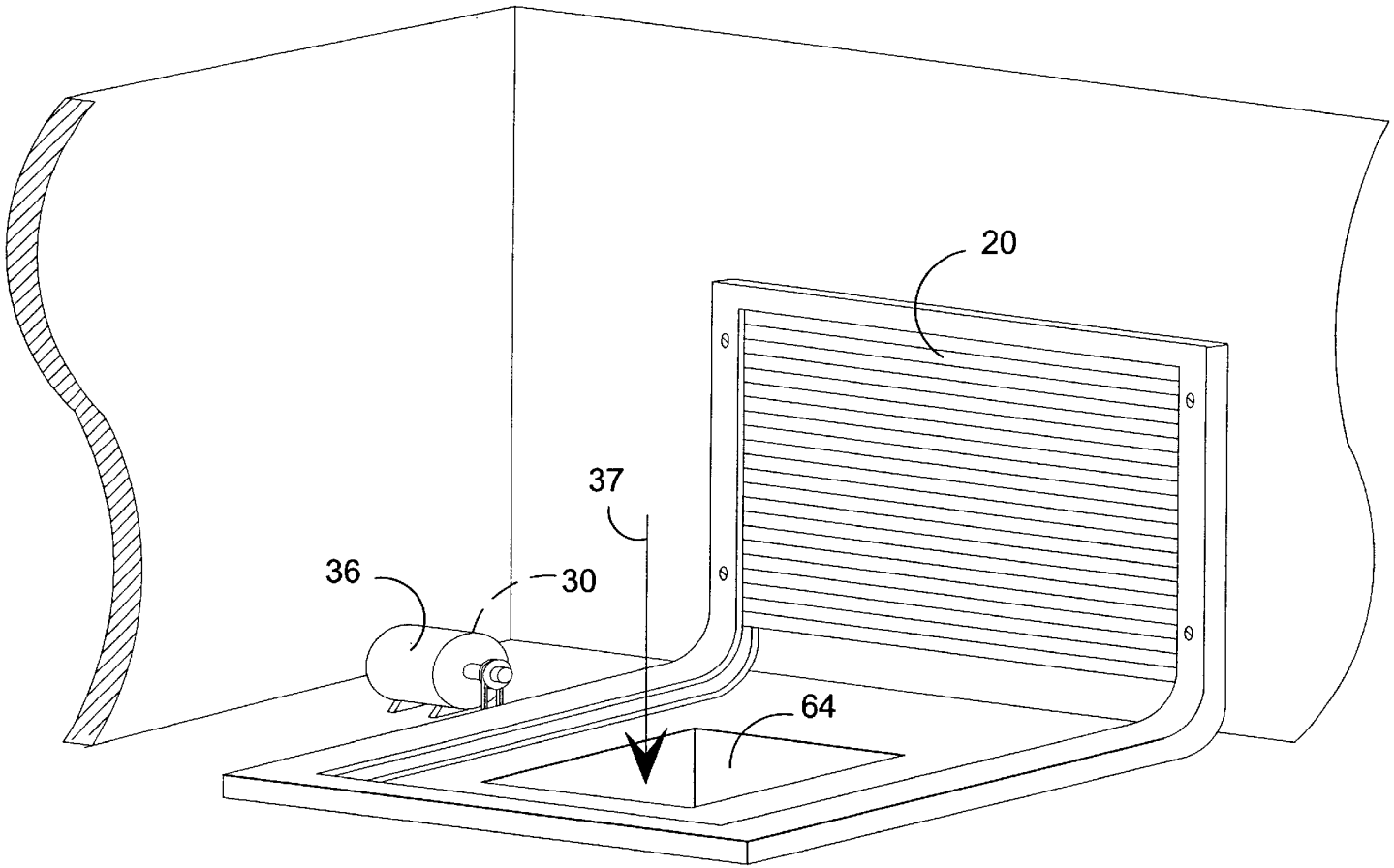
FIG. 9 is a perspective view of the transition door in the open position.

Turning to FIG. 9, shown therein is an illustrative view of the extraction system 10 in use under normal conditions having an open door mechanism. The smoke extraction system has a motorized louvered door 20 with a motor 36 and door relay 30 that under normal conditions remains closed. If smoke is detected the system engages the venting mode of the central air condition unit through the thermostat.

Figure 10:
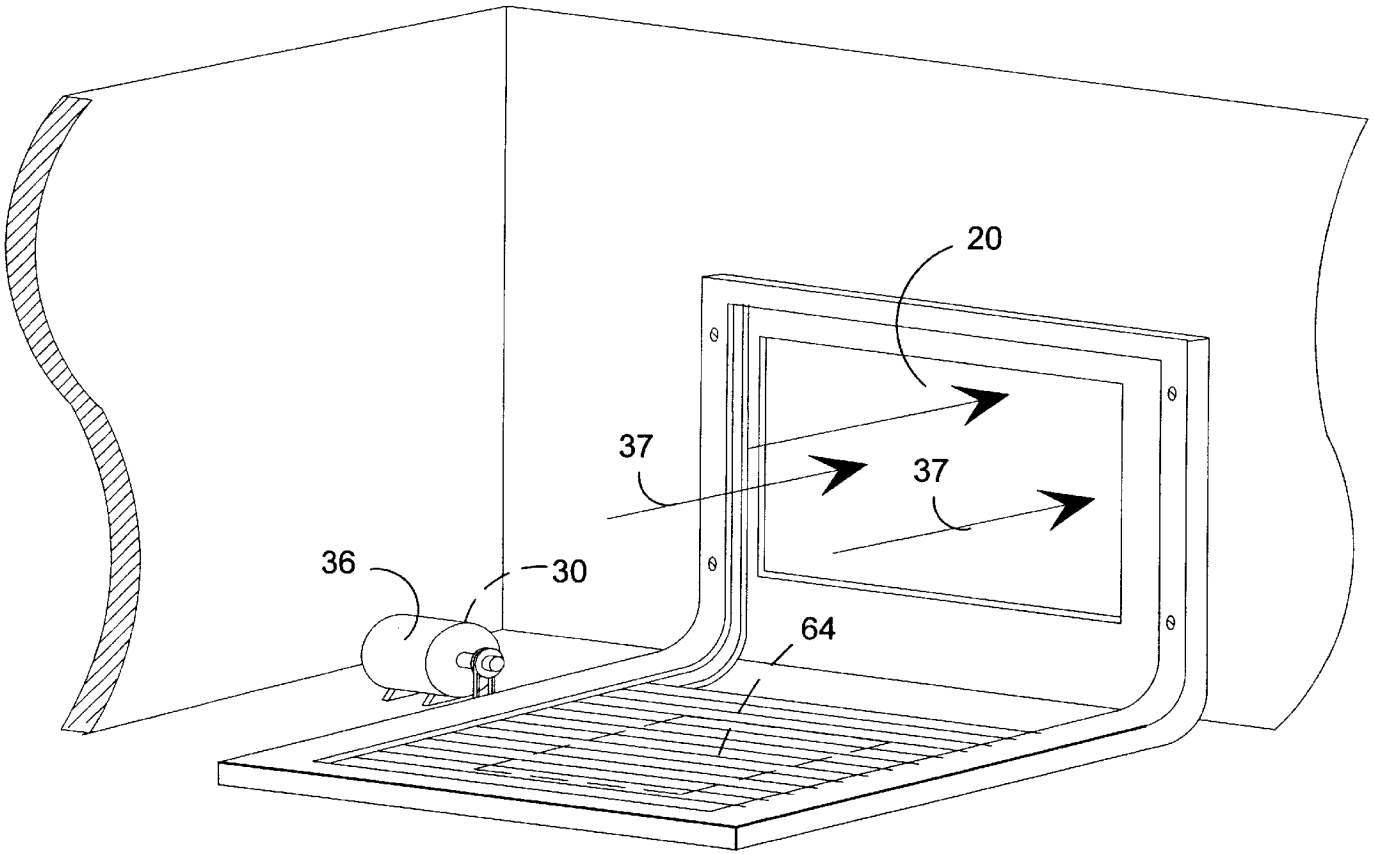
FIG. 10 is a perspective view of the transition door in the closed position.

Turning to FIG. 10, shown therein is an illustrative view of the smoke extraction system 10 in use during normal conditions having a closed door mechanism. The smoke exhaust system has a motorized louvered door 20 with a motor 36 and door relay 30. Depicted is the smoke exhaust operating condition of a central air conditioning unit 12 having the smoke extraction system 10 installed therein. At least one smoke detector 16 signals the thermostat 18 to shut down the air conditioning mode if operational and to engage the a/c vent mode. Simultaneously the thermostat 18 signals the A/C sensor 38 which opens the louvered transition door 20 closing the supply air duct opening 64. The A/C vent air is exhausted through the a/c unit duct work shown by arrow 37 creating a draft that draws smoke out of the building and away from the A/C unit.

Figure 11:
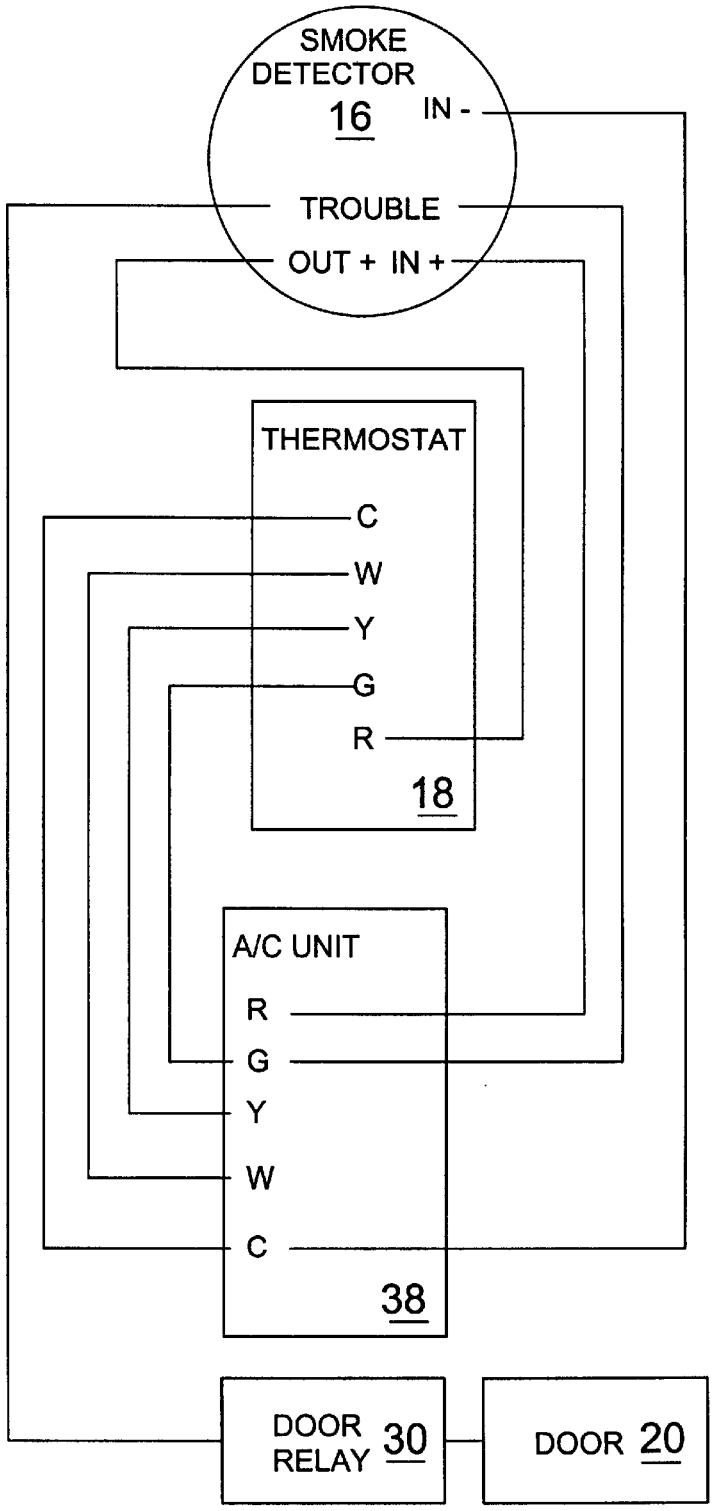
FIG. 11 is a wiring diagram for the present invention.

Turning to FIG. 11, shown therein is a wiring diagram of the present invention. The wiring diagram depicts the components of the smoke extraction system 10 having the following legend: 'R'—Power, 'G'—Fan, 'Y'—Cooling, 'W'—Heat, 'C'—Common. The smoke detector 16 signals the A/C sensor to engage the fan in addition to signaling the transition door relay 30 which signals the motor to open the transition door 20. The A/C unit will exhaust out the transition door 20 causing a draft through the A/C duct work drawing the smoke to be exhausted away from the A/C unit out the transition door 20.

We claim:

1. An air conditioning system for providing a smoke extraction system, the air conditioning system being connected to a duct system of a building, the duct system having an air supply duct and an air return duct, comprising:

a) a smoke detector for detecting the presence of smoke and transmitting a smoke signal;

b) a thermostat for receiving said smoke signal from said smoke detector and responsively engaging a venting system of said air conditioning system;

c) said venting system including a motorized vent door which is thereby triggered to open upon receiving a signal from said thermostat, said motorized vent door being a louvered door movable in a track between a first position closing off an air supply duct opening to the outside and second position at right angles to the first position unblocking said air supply duct opening to the outside; and, d) said motorized vent door being disposed in an enclosure of an air conditioning unit in said air conditioning system whereby air from the air conditioning system is vented to the outside thereby creating a draft in an air return duct so that smoke is removed from an interior of the building.

2. The apparatus of claim 1, further comprising a microprocessor to permit the operation of a plurality of room air vents to be coordinated with the operation of a plurality of smoke detectors whereby the room air vents near a smoke source are opened while the room vents removed from a smoke source are closed in order to accelerate the removal of smoke from the interior of a building.

3. An apparatus for a smoke extraction system for attachment to an existing air conditioning system of a building, the air conditioning system having an air supply duct and an air return duct, comprising:

a) a smoke detector whereby the presence of smoke can be detected and a signal can be thereafter transmitted to a thermostat;

b) said thermostat receiving said signal and thereafter transmitting another signal to an air conditioning sensor; and c) said air conditioning sensor thereupon triggering the opening of a motorized vent door in an enclosure between an air conditioner in said air conditioning system and said air supply duct upon receiving a signal from said thermostat, thereby creating a draft in the return duct so that smoke is removed from an interior of the building.

4. The apparatus of claim 3, comprising a microprocessor to permit the operation of a plurality of room air vents to be coordinated with the operation of a plurality of smoke detectors whereby the room air vents near a smoke source are opened while the room vents removed from a smoke source are closed in order to accelerate the removal of smoke from the interior of a building.

* * * * *